US007481688B2

(12) United States Patent
Kobayashi

(10) Patent No.: US 7,481,688 B2
(45) Date of Patent: Jan. 27, 2009

(54) PROPULSION UNIT AND BOAT

(75) Inventor: Noboru Kobayashi, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/222,017

(22) Filed: Sep. 8, 2005

(65) Prior Publication Data

US 2006/0052014 A1 Mar. 9, 2006

(30) Foreign Application Priority Data

Sep. 8, 2004 (JP) ..... 2004-261582

(51) Int. Cl.
*B63H 5/20* (2006.01)
*B63H 5/125* (2006.01)
*B63H 20/08* (2006.01)

(52) U.S. Cl. ..... 440/53; 440/61 R; 440/61 T

(58) Field of Classification Search ..... 440/1, 440/53, 61 R, 61 T, 61 G; 114/145 R, 145 A
See application file for complete search history.

(56) References Cited

U.S. PATENT DOCUMENTS

| | | | | |
|---|---|---|---|---|
| 2,230,958 | A * | 2/1941 | Langdon | 415/8 |
| 2,548,121 | A * | 4/1951 | Reid | 415/8 |
| 2,608,946 | A * | 9/1952 | Hoover | 440/66 |
| 2,864,330 | A * | 12/1958 | Cochran | 114/145 A |
| 2,959,148 | A * | 11/1960 | Canazzi | 440/66 |
| 3,768,432 | A * | 10/1973 | Spaulding | 440/66 |
| 3,965,839 | A * | 6/1976 | Lenz | 114/145 A |
| 4,278,040 | A * | 7/1981 | Doerffer et al. | 114/170 |
| 4,781,632 | A * | 11/1988 | Litjens et al. | 440/66 |
| 5,344,345 | A * | 9/1994 | Nagata | 440/44 |
| 5,755,601 | A * | 5/1998 | Jones | 440/1 |
| 5,938,490 | A * | 8/1999 | Rodler | 440/41 |
| 6,155,893 | A * | 12/2000 | Belmont | 440/66 |
| 6,722,932 | B2 * | 4/2004 | Yanagihara | 440/41 |
| 7,029,342 | B2 * | 4/2006 | Mallea | 440/41 |
| 2004/0090195 | A1 * | 5/2004 | Motsenbocker | 318/109 |
| 2004/0149241 | A1 * | 8/2004 | Shomura et al. | 123/41.7 |

FOREIGN PATENT DOCUMENTS

| | | |
|---|---|---|
| JP | 05-201388 | 8/1993 |
| JP | 06-156379 | 6/1994 |
| JP | 6-61697 | 8/1994 |
| JP | 2000-142584 | 5/2000 |

OTHER PUBLICATIONS

The American Heritage Dictionary (Second College Edition), Houghton Mifflin Company, Boston, MA, 1982 (p. 993).*

* cited by examiner

*Primary Examiner*—Jesus D Sotelo
*Assistant Examiner*—Daniel V Venne
(74) *Attorney, Agent, or Firm*—Knobbe, Martens, Olson & Bear, LLP

(57) ABSTRACT

A boat can have a propulsion unit connected to a rear surface of a transom plate of a hull. The propulsion unit can have a propeller for producing thrust, a power device for driving the propeller, and a power transmission mechanism for transmitting power from the power device to the propeller. The propulsion unit can also include a braking device configured to exert a generally vertical upward force on the propulsion unit during a braking operation.

31 Claims, 16 Drawing Sheets

(a)

(b)

PROPULSION UNIT AND BOAT

PRIORITY INFORMATION

This application is based on and claims priority under 35 U.S.C. § 119 to Japanese Patent Application No. 2004-261582, filed on Sep. 8, 2004, the entire contents of which is hereby expressly incorporated by reference.

BACKGROUND OF THE INVENTIONS

1. Field of the Inventions

The present inventions relate to a propulsion unit for a boat, and more particularly, to propulsion units capable of braking.

2. Description of the Related Art

Outboard motors are a popular choice for powering small boats, due partly to the flexibility they offer to owners and operators of such boats. For example, removing and replacing or changing an outboard motor is far less difficult than removing and replacing an inboard/outboard propulsion system. Further, outboard motors can be tilted up when not in use, thereby allowing all of the cooling water to drain completely out of the entire outboard motor even when the associated boat is floating in water. Inboard/outboard motors cannot be drained in such manner.

When operating a boat in a forward direction, whether or not it is powered by an inboard/outboard or outboard motor, operators can shift their boats into reverse to slow the boat's forward movement. Japanese patent publications JP-A-Hei 5-201388 (pages 1 to 3 and FIGS. 1 and 2), JP-A-2000-142584 (pages 1 to 7 and FIGS. 1 to 6), JP-A-Hei 6-61697 (pages 1 to 3 and FIGS. 1 to 8), H06-156379 (pages 1 to 4 and FIGS. 1 to 4) each disclose other types of braking systems for boats.

SUMMARY OF THE INVENTION

An aspect of at least one of the embodiments disclosed herein includes the realization that the braking performance of a boat, whether it's propulsion system includes an inboard/outboard or outboard motor, can be improved by configuring the propulsion system to generate a generally upward force during a braking procedure. Such a force can increase the surface area of the bow area of the hull that is in contact with the water. As such, the hydro-dynamic resistance of the hull is increased, which thereby provides additional braking force slowing the boat.

Thus, in accordance with an embodiment, a propulsion unit can be configured to be connected to a transom plate of a hull. The propulsion unit can comprise a propeller configured to produce thrust, a power device configured to drive the propeller, a power transmission mechanism configured to transmit power from the power device to the propeller, and a braking device configured to exert a generally upward force on the propulsion unit.

In accordance with another embodiment, a propulsion unit can be configured to be connected to a transom plate of a hull of a boat. The propulsion unit can comprise a propeller configured to produce thrust, a power device configured to drive the propeller, a power transmission mechanism configured to transmit power from the power device to the propeller, and means for selectively applying a generally upward force on the propulsion unit for providing a braking force to a boat carrying the propulsion unit.

BRIEF DESCRIPTION OF THE DRAWINGS

The above-mentioned and the other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

Figure 1:
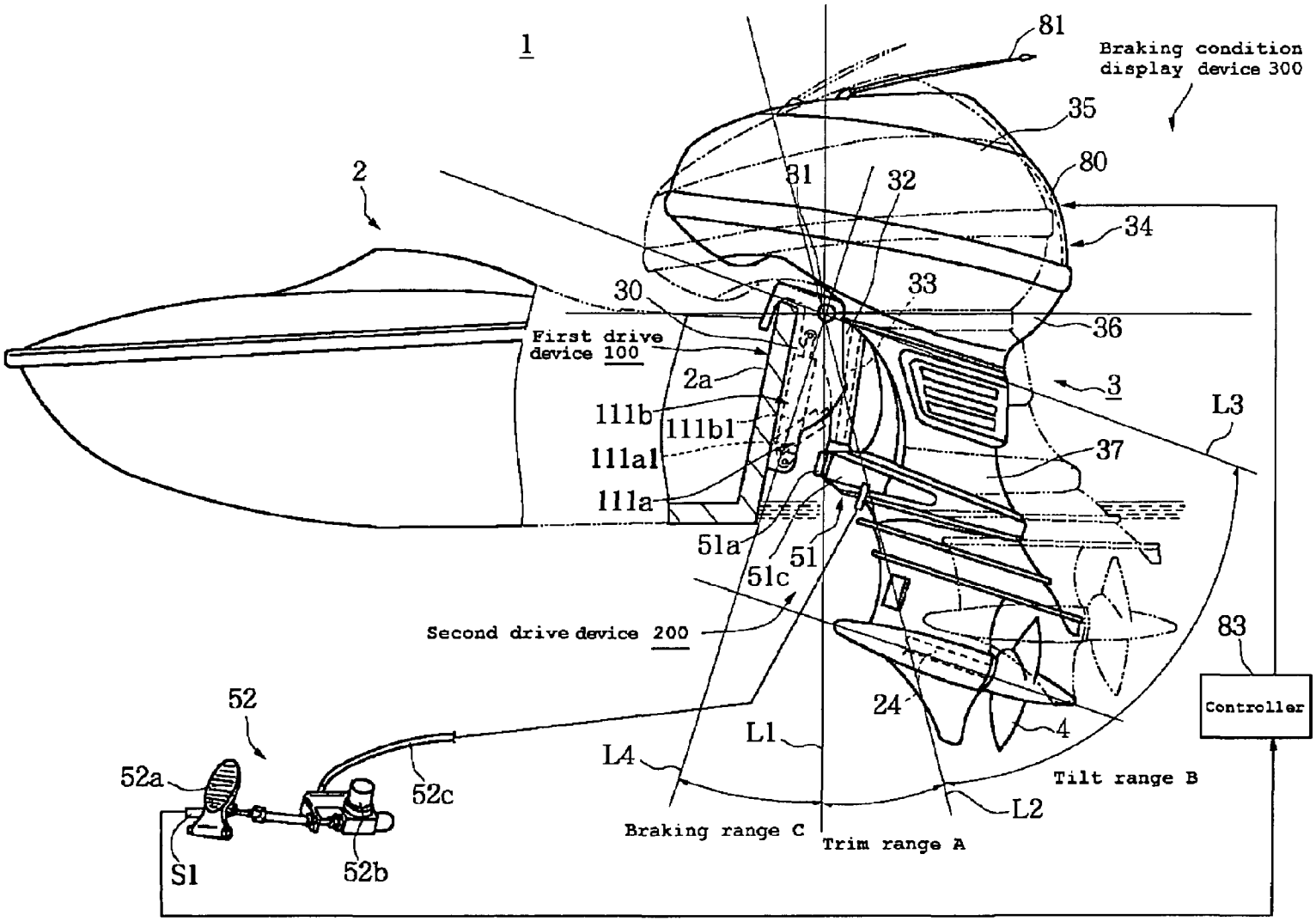
FIG. 1 is a side view of a boat having a propulsion unit, the boat being illustrated partially in section and reduced in size.
Figure 2:
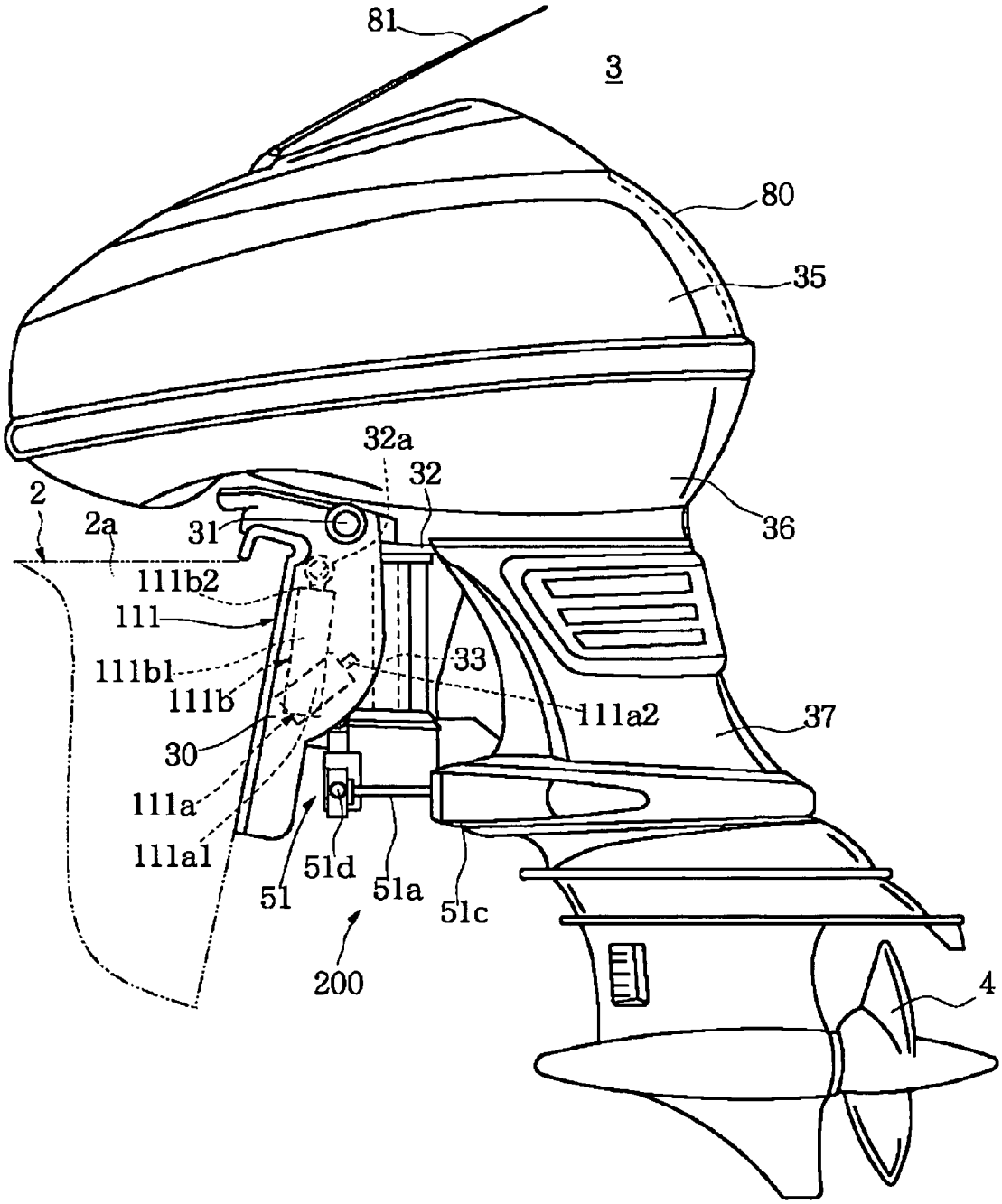
FIG. 2 is an enlarged side view of the propulsion unit.

FIG. 1 is a side view of a boat 1 having a propulsion unit 3 in accordance with an embodiment. The embodiments disclosed herein are described in the context of a small boat having an outboard motor because the embodiments disclosed herein have particular utility in this context. However, the embodiments and inventions herein can also be applied to other boats having other types of propulsion units, such as a stern drive, as well as other types of vehicles.

As used herein, the terms "front," "rear," "left," "right," "up" and "down," correspond to the direction assumed by a driver of the boat.

The boat 1 can include a transom plate 2*a* at the rear of a hull 2. The hull 2 can be provided with a propulsion unit 3. The propulsion unit 3 can be is an outboard motor that has a clamp bracket 30 fixed to a rear surface of the transom plate 2*a* of the hull 2. The propulsion unit 3 can also include a swivel bracket 32 supported by the clamp bracket 30 for freely swinging up/down about a tilt shaft 31 as a pivot, and a main propulsion unit 34 connected steerably to the swivel bracket 32 through a steering shaft 33.

Figure 5:
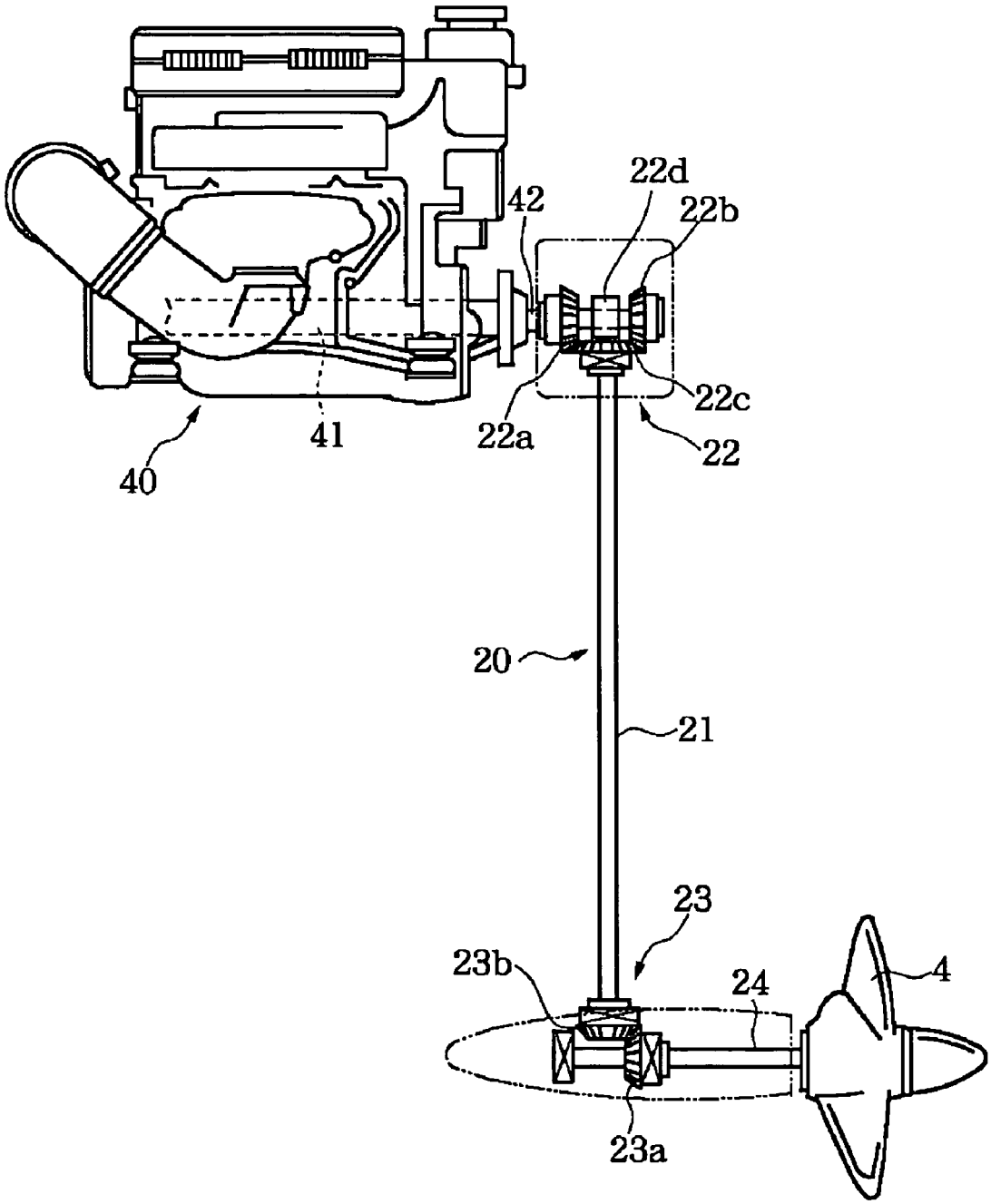
FIG. 5 shows a drive means and a power transmission means.
Figure 6:
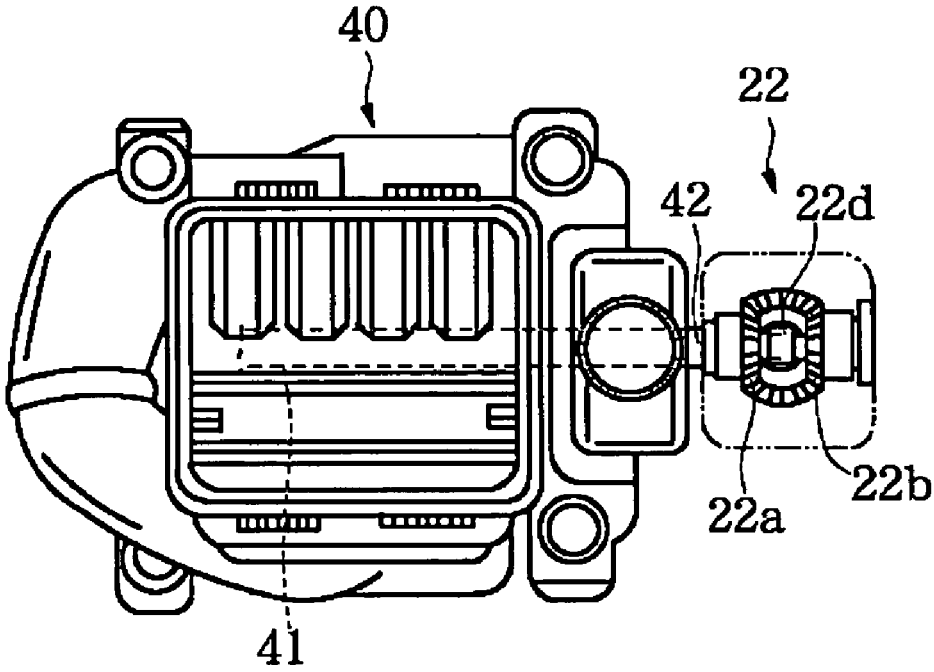
FIG. 6 is a top plan view of the drive means.

The main propulsion unit 34 can have a horizontally-arranged four-stroke engine 40, which constitutes a power device, mounted in a top cowling 35, as shown in FIGS. 5 and 6. However, this is merely one type of engine that can be used.

Other types of engines can be used which operate on other types of combustion principles (e.g., diesel, rotary, two-stroke), have other cylinder configurations (V-type, W-type, horizontally opposed, etc.), and have other numbers of cylinders.

A power transmission mechanism 20 for transmitting power from the engine 40 to a propeller 4 is accommodated through an upper casing 36 connected to the bottom of the cowling 35 and a lower casing 37. The engine 40 can have a crankshaft 41 that is oriented generally along the direction of cruising. An output shaft 42 can be connected to the crankshaft 41 on its rear side in the direction of cruising.

The power transmission mechanism 20 can have a drive shaft 21, a forward-reverse shift unit 22 and an operatively-connected unit 23. The drive shaft 21 can be oriented vertically.

The forward-reverse shift unit 22 can be disposed on the topside of the drive shaft 21 and can have a first gear 22*a*, a second gear 22*b*, an upper gear 22*c* and an electromagnetic clutch 22*d*, although other configurations can also be used. The first gear 22*a* and the second gear 22*b* can be mounted on the output shaft 42 for free movement. The upper gear 22*c* can be mounted to the topside of the drive shaft 21.

The output shaft 42 can be connected to the first gear 22*a* or the second gear 22*b* via the electromagnetic clutch 22*d*. Rotation of the first gear 22*a* or the second gear 22*b* can be transmitted to the upper gear 22*c*. Changing the direction of rotation of the upper gear 22*c* allows shifting power from the drive shaft 21 between forward and reverse.

The operatively-connected unit 23 can be disposed on the underside of the drive shaft 21 and can have a drive gear 23*a* and a lower gear 23*b*. The drive gear 23*a* can be provided on a propeller shaft 24. The lower gear 23*b* can be provided below the drive shaft 21.

The power of the drive shaft 21 can be transmitted from the lower gear 23*b* to the drive gear 23*a*. It can be further transmitted from the drive gear 23*a* to the propeller shaft 24 to rotate the propeller 4 for producing thrust.

The forward-reverse shift unit 22 can be disposed on the topside of the drive shaft 21 while the operatively-connected unit 23 is on the underside of the drive shaft 21. The underwater lower casing 37 can be configured to contain only the operatively-connected unit inside 23, which can reduce the size of the lower casing 37 and therefore reduce the water resistance acting thereon.

Figure 7:
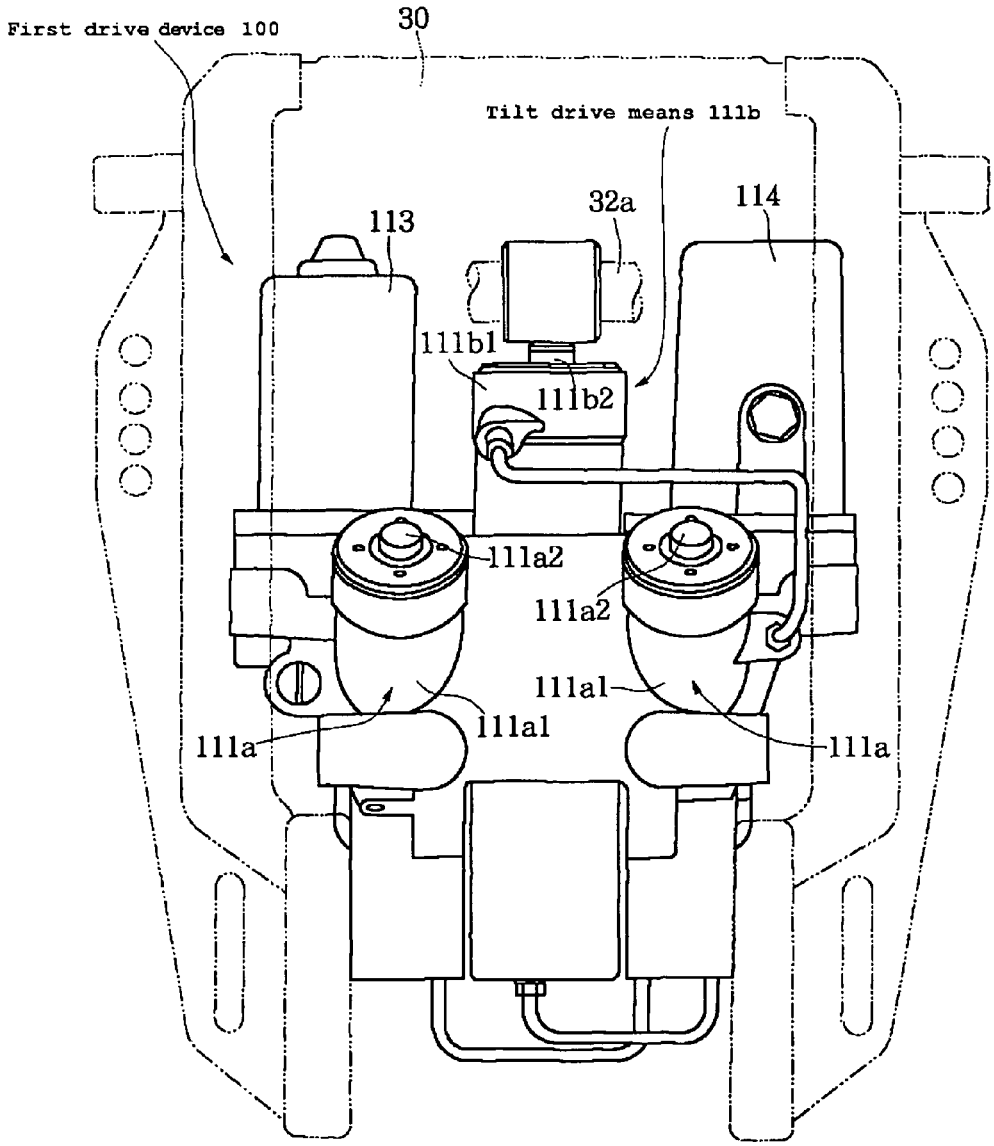
FIG. 7 is an overall view of a power trim and tilt system.

As shown in FIGS. 1 and 7, the propulsion unit 3 can have a first drive device 100 for rotating the main propulsion unit 34 by a given angle in the direction of the tilt shaft. The first drive device 100 can be comprised of a power trim and tilt system and can have a trim drive device 111*a* and a tilt drive device 111*b*.

The trim drive device 111*a* has a pair of hydraulic cylinders 111*a*1 and a pair of piston rods 111*a*2. Each hydraulic cylinder 111*a*1 can be provided with the corresponding piton rod 111*a*2. The hydraulic cylinder 111*a*1 can be attached to the clamp bracket 30. The piston rod 111*a*2 supports the swivel bracket 32 at its top end. When the hydraulic cylinder 111*a*1 is activated, the piston rod 111*a*2 extends/retracts. Accordingly, the main propulsion unit 34, together with the swivel bracket 32, rotates up/down about the axis or the horizontal tilt shaft 31 with respect to the transom plate 2*a* of the hull 2 within a trim range A.

The tilt drive device 111*b* can have a hydraulic cylinder 111*b*1 and a piston rod 111*b*2 connected therewith. The hydraulic cylinder 111*b*1 can be attached to the clamp bracket 30. The top end of the piston rod 111*b*2 can be rotatably supported by a horizontal axis 32*a* of the swivel bracket 32. When the hydraulic cylinder 111*b*1 is activated, the piston rod 111*b*2 extends/retracts. Accordingly, the main propulsion unit 34, together with the swivel bracket 32, rotates up/down about the axis or the horizontal tilt shaft 31 with respect to the transom plate 2*a* of the hull 2 within a tilt range B.

A motor 113 and an oil tank 114 for feeding oil to the hydraulic cylinders 111*a*1 and 111*b*1 can be provided on the clamp bracket 30. As described above, the trim drive device 111*a* allows the main propulsion unit 34 to rotate up/down with respect to the transom plate 2*a* of the hull 2 within the trim range A between an initial position L1 and a first position L2. In turn, the tilt drive device 111*b* allows the main propulsion unit 34 to rotate up/down with respect to the transom plate 2*a* of the hull 2 within the tilt range B between the first position L2 and a second position L3. A trim angle can be adjusted by the trim drive device 111*a* during cruising while the main propulsion unit 34 can be rotated by the tilt drive device 111*b* within an angle range greater than the trim angle range.

Figure 8:
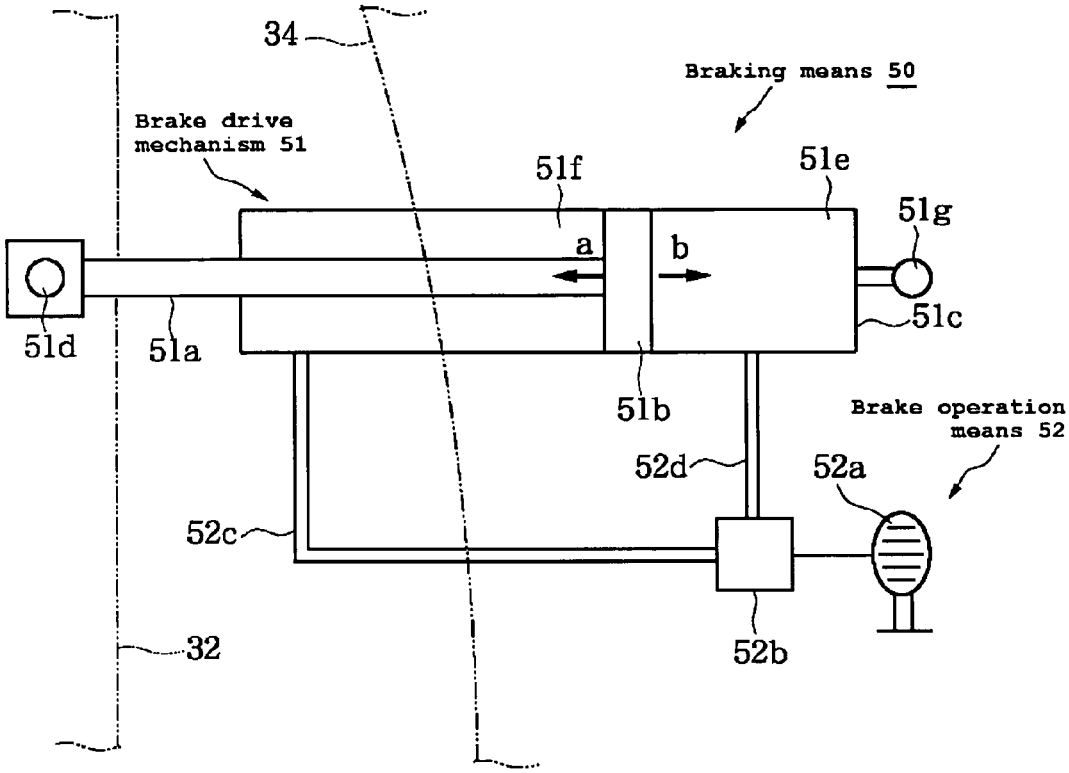
FIG. 8 shows a configuration of a braking device.

In some embodiments, the propulsion unit 3 can include a braking device 50 configured to exert a vertically-upward force on the main propulsion unit through a braking operation. As shown in FIG. 8, the braking device 50, having a brake drive mechanism 51 and a brake operation device 52, can be included in a second drive device 200.

The brake drive mechanism 51 can have a cylinder rod 51*a*, a piston 51*b* and a brake cylinder 51*c*. One end of the cylinder rod 51*a* can be supported by the swivel bracket 32 rotatably about a support shaft 51*d* as a pivot while the other end thereof can be connected to the piston 51*b*. The piston 51*b* can be movably disposed in the brake cylinder 51*c*, the inside of which can be partitioned by the piston 51*b* into a first chamber 51*e* and a second chamber 51*f*. The brake cylinder 51*c* can be supported by the main propulsion unit 34 for rotation about the support shaft 51*g* as a pivot.

The brake operation device 52 can have a brake pedal 52*a*, a hydraulic pressure feeder 52*b* and brake hoses 52*c*, 52*d*, although other configurations can also be used. Operating the brake pedal 52*a* allows the hydraulic pressure feeder 52*b* to feed hydraulic fluid to the second chamber 51*f* in the brake cylinder 51*c* through the brake hose 52*c*. The hydraulic fluid in the first chamber 51*e* returns to the hydraulic pressure feeder 52*b* through the brake hose 52*d*, so that the piston 51*b* moves toward the direction shown by the arrow "b". The hydraulic fluid fed to the second chamber 51*f* enables the main propulsion unit 34 to move relative to the hull 2 from the initial position L1 to a braking position L4. A braking range C refers to the range for which the main propulsion unit 34 moves between the initial position L1 and the braking position L4.

In such a manner, the second drive device 200 allows the main propulsion unit 34 to move from the initial position L1 to the braking position L4 relative to the hull 2. With the main propulsion unit 34 in the braking position L4, the propeller shaft 24 of the propeller 4 tilts downward to the rear with respect to the horizontal plane. The second drive device 200 allows the main propulsion unit 34 to rotate about the tilt shaft further toward the rear surface of the transom plate than the rotation by the first drive means 100 by the given angle between the trim range A and tilt range B. This results in movement of the main propulsion unit 34 to the braking range C that is further toward the rear surface of the transom plate beyond the trim range A.

During cruising, operating the brake allows the main propulsion unit 34 to rotate about the tilt shaft toward the rear surface of the transom plate from the trim range A to the braking range C. This causes the propeller shaft 24 to tilt downward toward the rear with respect to the horizontal plane, which produces a force to lift the main propulsion unit 34 up. Thus, the stern can be lifted up while the bow can be moved down, so that an area, where the bow is subjected to water, increases. The water resistance against the bow therefore increases, thereby producing a greater braking force. Particularly, the braking device 50 can be disposed on the main propulsion unit 34 arranged at the rear of the transom plate, so that a vertically upward force can be exerted on the lower part of the main propulsion unit that is furthest from the bow, and a greater force therefore acts on the bow to move it down. Thus, in contrast to a relatively small vertically upward force exerted on the main propulsion unit, the force to move the bow down becomes greater, resulting in a greater braking force.

With more water resistance against the bow, a shorter distance can be achieved for the stopping the boat 1. Also, the greater hull speed during braking, the greater force to lift the main propulsion unit 34 upwardly. This further increases the water resistance against the bow and therefore produces a greater braking force.

Releasing the brake pedal 52*a* back to the initial position allows the hydraulic pressure feeder 52*b* to feed hydraulic fluid to the first chamber 51*e* in the brake cylinder 51*c* through the brake hose 52*c*. The hydraulic fluid in the second chamber 51*f* returns to the hydraulic pressure feeder 52*b* through the brake hose 52*c*, so that the piston 51*b* moves toward the direction shown by the arrow "a" to return to its initial position.

In the case that the brake operation can be performed in such a manner during cruising, output from the engine 40, can be decreased by the operator or automatically in association with the brake operation. For example, but without limitation, the main propulsion unit 34 can be moved relative to the hull 2, from the initial position L1 to the braking position L4, so that the propeller shaft 24 of the propeller 4 tilts downward to the rear with respect to the horizontal plane. At this moment, with the lapse of a certain period (e.g. one second), a throttle (not shown) can be automatically closed to decrease the engine speed.

In some embodiments, the brake drive mechanism 51 can be arranged such that an angle of the main propulsion unit 34 with respect to the swivel bracket 32 can be changed. However, the brake drive mechanism 51 can also be arranged between the power trim and tilt system and the clamp bracket 30 so that the posture of the propulsion unit 3 including the main propulsion unit 34 and the first drive means 100 can be changed. Alternatively, the brake drive mechanism 51 can also be arranged such that the position (angle) of the clamp bracket 30 with respect to the transom plate 2*a* can be changed. Other configurations can also be used. Further, the brake drive mechanism 51 may also be incorporated into the power trim and tilt system or be separately provided.

In some embodiments, a braking condition display device 300 which can be configured to display braking conditions of the braking device 50 can be provided. The braking condition display device 300 can include a brake-operation detecting sensor S1, a controller 83 and a light-emitting display 80, although other configurations can also be used. The brake-operation detecting sensor S1 can be configured to detect the brake operation of the brake pedal 52*a* and to send a brake-operation detection signal to the controller 83. Based on the brake-operation detection signal, the controller 83 can be configured to activate the light-emitting display 80 for brake-warning display.

The controller 83 can be made up of a CPU, RAM, ROM, etc., and designed to control all or some of operations of the propulsion unit 3. The light-emitting display 80 can comprise a lamp, a liquid crystal display, an electroluminescence (EL), a light-emitting diode, etc.

Figure 3:
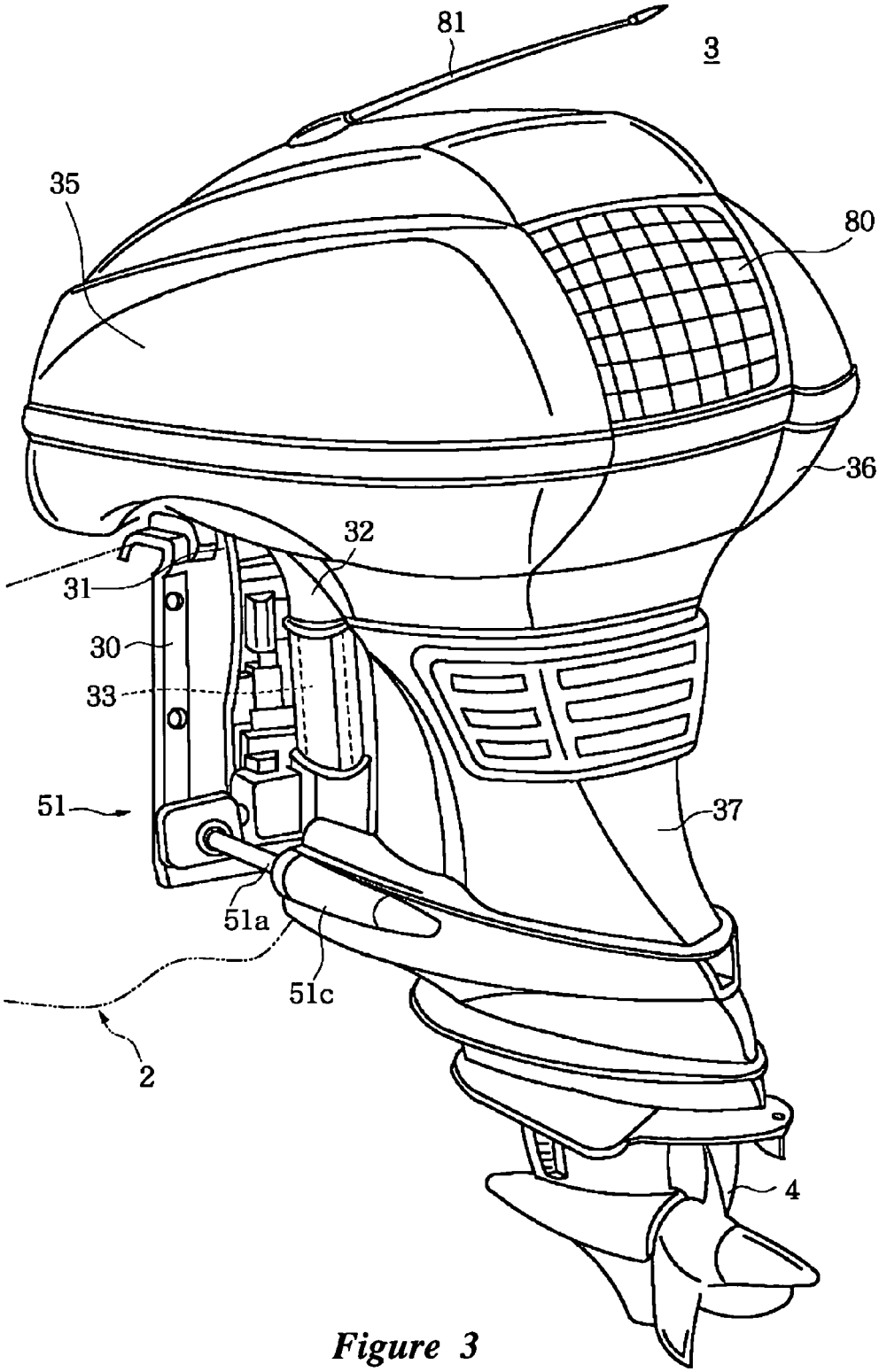
FIG. 3 is a perspective view of the propulsion unit.
Figure 4:
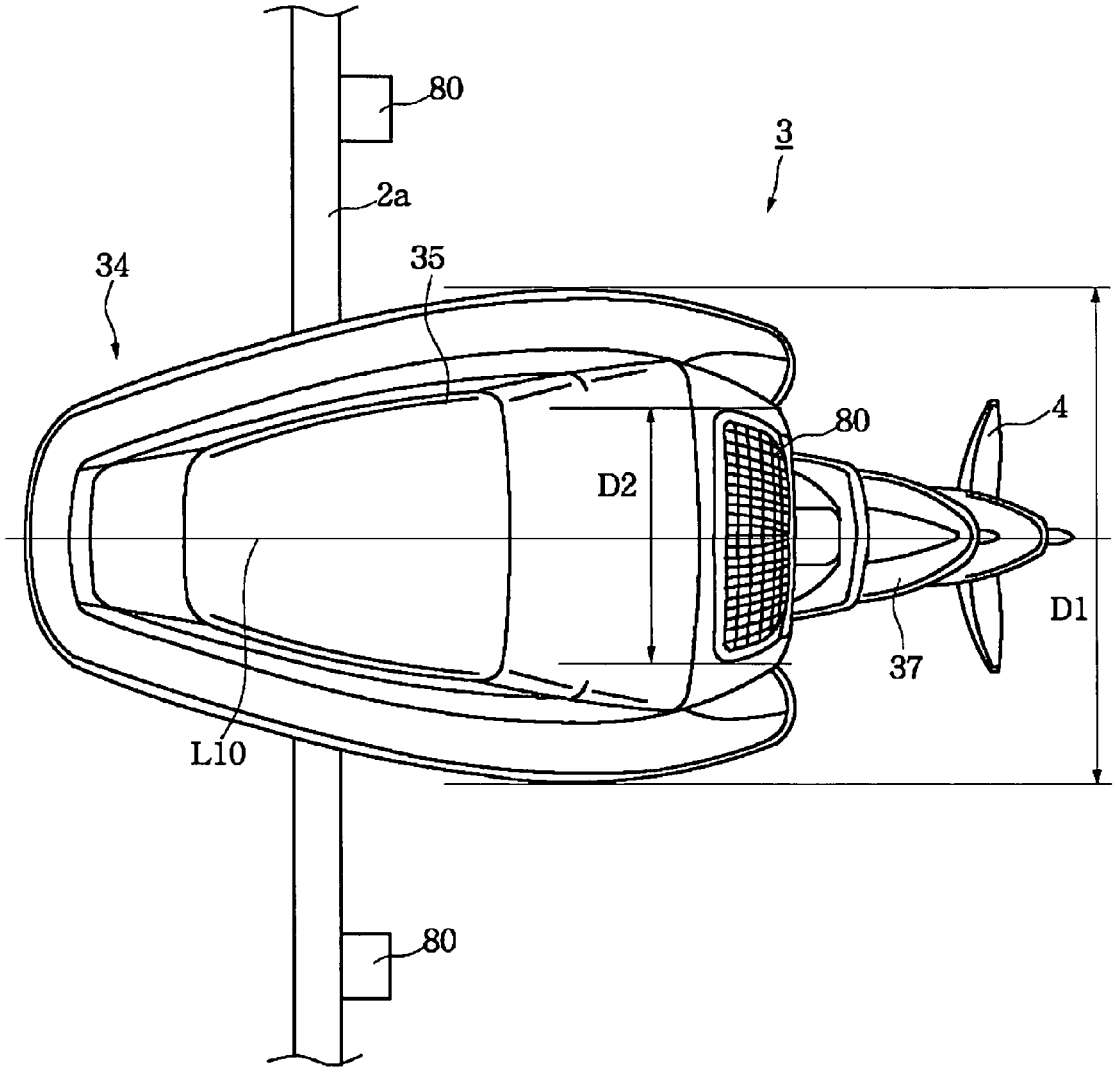
FIG. 4 is a top plan view of the propulsion unit.

The light-emitting display 80 can be located on the rear side of the propulsion unit 3 in the cruising direction, although other orientations can also be used. In some embodiments, as shown in FIGS. 3 and 4, the light-emitting display 80 can be arranged within the width range D2, which can be as wide as or wider than the one-third of the lateral width D1 of the cowling 35 for the propulsion unit 3 that extends perpendicular to the cruising direction L10. In such a manner, the light-emitting display 80 can be located on the propulsion unit 3 by being assembled onto the cowling 35. This allows the light-emitting display 80 as well as the braking device 50 to be integral with the propulsion unit 3.

The light-emitting display 80 can be arranged within the width range D2, which can be as wide as or wider than the one-third of the lateral width D1 of the cowling 35 for the propulsion unit 3 that extends perpendicular to the cruising direction L10. This makes it easier to visually recognize the braking condition display from the back.

As shown in FIG. 4, the light-emitting display 80 can also be located on the rear part 2*a* of the hull 2. In some embodiments, a pair of left and right light-emitting displays 80 can be mounted on the both sides of the propulsion unit 3 or on the rear part 2*a* of the hull 2. In this manner, the light-emitting displays 80 can be provided on the rear part 2*a* of the hull 2 separately from the propulsion unit 3. This facilitates the attachment or replacement of the light-emitting displays 80.

The light-emitting displays 80 can also be located both on the cowling 35 of the propulsion unit 3 and on the rear part 2*a* of the hull 2, which can provide easier visual recognition of the braking condition display from the back.

Figure 9:
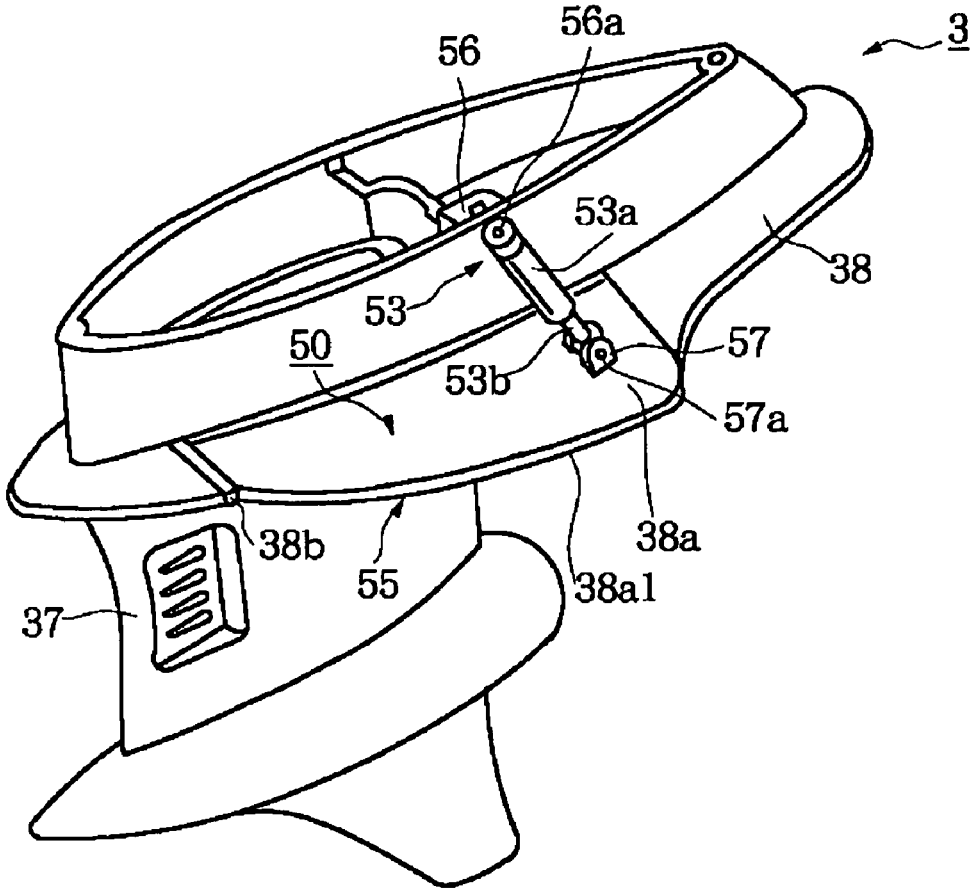
FIG. 9 is a perspective view, showing an embodiment in which a resistance member is part of a cavitation plate.
Figure 10:
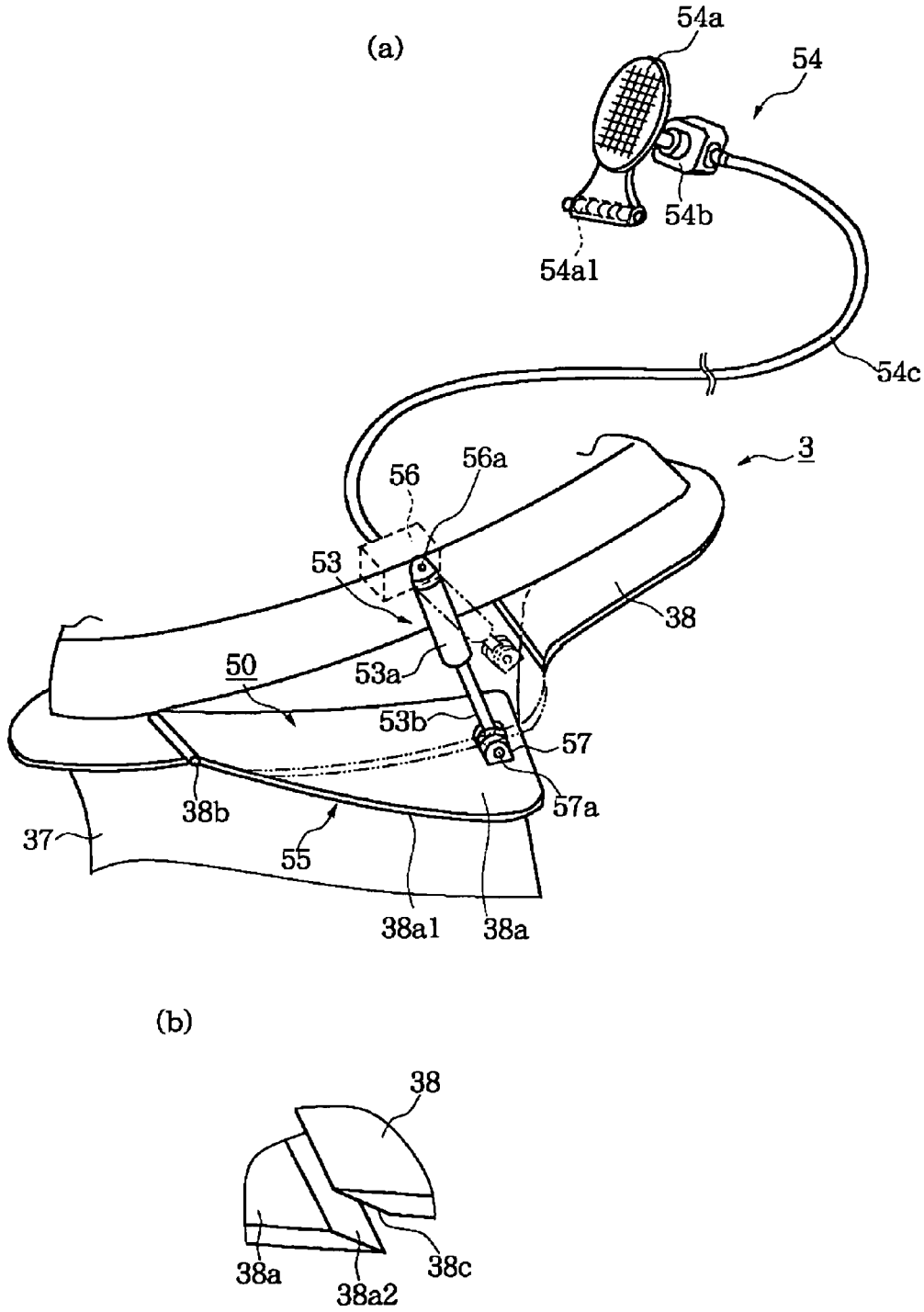
FIGS. 10(*a*) and 10(*b*) show a condition under which the braking operation is performed.

Modifications of the braking device 50 are shown in FIGS. 9 through 16 and are identified generally by the reference numerals 50', 50", and 50'''. The braking device 50' is initially described with reference to FIGS. 9 and 10(*a*), 10(*b*). FIG. 9 is a perspective view showing an embodiment in which a resistance member is part of a cavitation plate. FIGS. 10(*a*) and 10(*b*) show a condition under which the brake operation can be performed.

The braking device 50' can include a resistance member 55, a resistance member opening/closing mechanism 53 and a brake operation device 54. In some embodiments, the resistance member 55 can be adapted to be part 38*a* of the cavitation plate 38 formed on the lower casing 37.

The part 38*a* of the cavitation plate 38 can be formed on the left and right sides of the lower casing 37 in the cruising direction, and each can be configured to pivot about a rotational shaft 38*b* to position a resistance surface 38*a*1 toward the forward cruising direction downward.

The part 38*a* of the cavitation plate 38 can have a surface 38*a*2 inclined upwardly toward its rearward part in the cruising direction. Such an upwardly-inclined surface 38*a*2 can be engaged with a surface 38*c* that can be inclined downwardly toward the forward part of the cavitation plate 38, so that the part 38*a* of the cavitation plate 38 can be prevented from rotating upwardly.

The resistance member opening/closing mechanism 53, having a cylinder 53*a* and a rod 53*b*, can be designed to open/close the resistance member 55 provided on the main propulsion unit 34 such that the water flows downwardly. The cylinder 53*a* and the rod 53*b* can be assembled in a sliding manner.

One end of the cylinder 53*a* can be connected to a mounting portion 56 formed on the lower casing 37 for rotation about a support pin 56*a* as a pivot. One end of the rod 53*b* can be connected to a mounting portion 57 formed on the resistance member 55 for rotation about a support pin 57*a* as a pivot.

The brake operation device 54 can have a brake pedal 54*a*, a hydraulic pressure feeder 54*b* and a brake hose 54*c*, although other configurations can also be used. Operating the brake pedal 54*a* can allow the hydraulic pressure feeder 54*b* to feed hydraulic fluid to the cylinder 53*a* through the brake hose 54*c* to push the rod 53*b*. This can cause the part 38*a* of the cavitation plate 38 to pivot about the rotational shaft 38*b* to open the resistance surface 38*a*1 downwardly.

During cruising, as shown in FIG. 9, the cavitation plate 38 can function by engaging the upward-inclined surface 38*a*2 of the part 38*a* of the cavitation plate 38 with the downwardly-inclined surface 38*c* of the cavitation plate 38. Operating the brake operation device 52 during cruising allows the hydraulic pressure feeder 54*b* to feed hydraulic fluid to the cylinder 53*a* through the brake hose 54*c* to push the rod 53*b*, as shown in FIG. 10. This causes the part 38*a* of the cavitation plate 38 to pivot about the rotational shaft 38*b* to tilt the resistance surface 38*a*1 downwardly, so as to oppose the flow of water generating during forward movement of the associated boat.

The water pressure acting against the surface 38*a*1 produces a force to lift the main propulsion unit 34 upwardly. Thus, the stern of the associated boat can be lifted upwardly while the bow can be moved downwardly. As such, the area of the bow contacting the water increases. The water resistance against the bow therefore increases, thereby producing a greater braking force.

Releasing the brake pedal 54*a* allows it to return to its initial position by a spring 54*a*1, which causes the hydraulic fluid in the cylinder 53*a* to return to the hydraulic pressure feeder 54*b* through the brake hose 54*c*.

Figure 11:
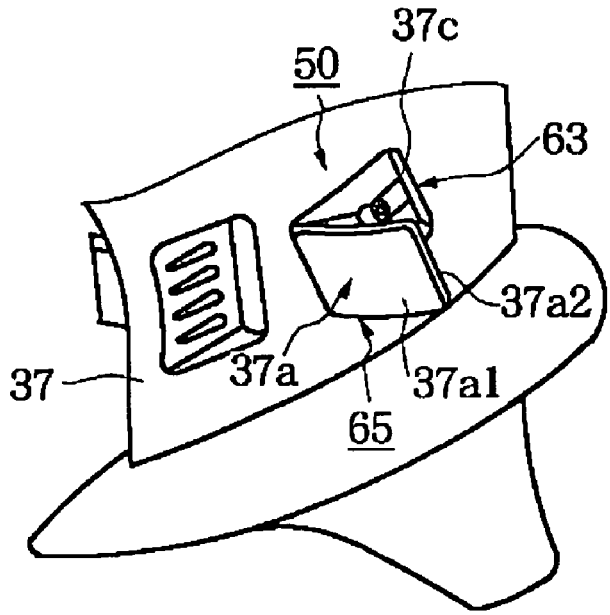
FIGS. 11(*a*) and 11(*b*) are perspective views, showing an embodiment in which a resistance member is part of a lower casing.
Figure 11:
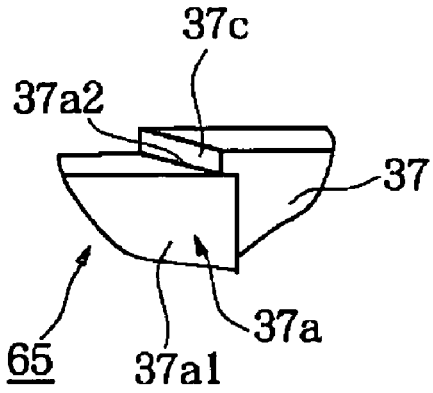
Figure 12:
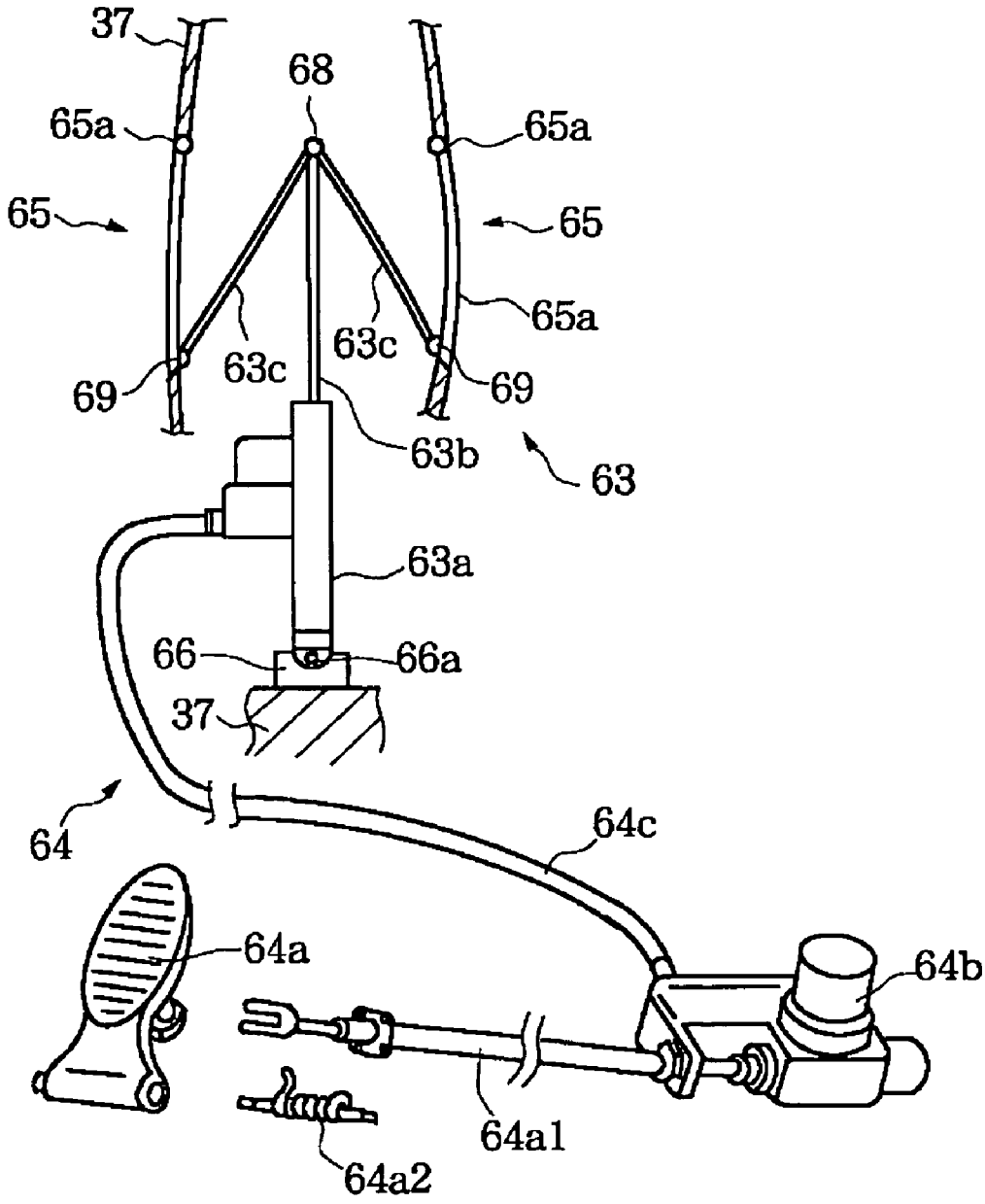
FIG. 12 shows a condition under which no braking operation is performed during cruising.
Figure 13:
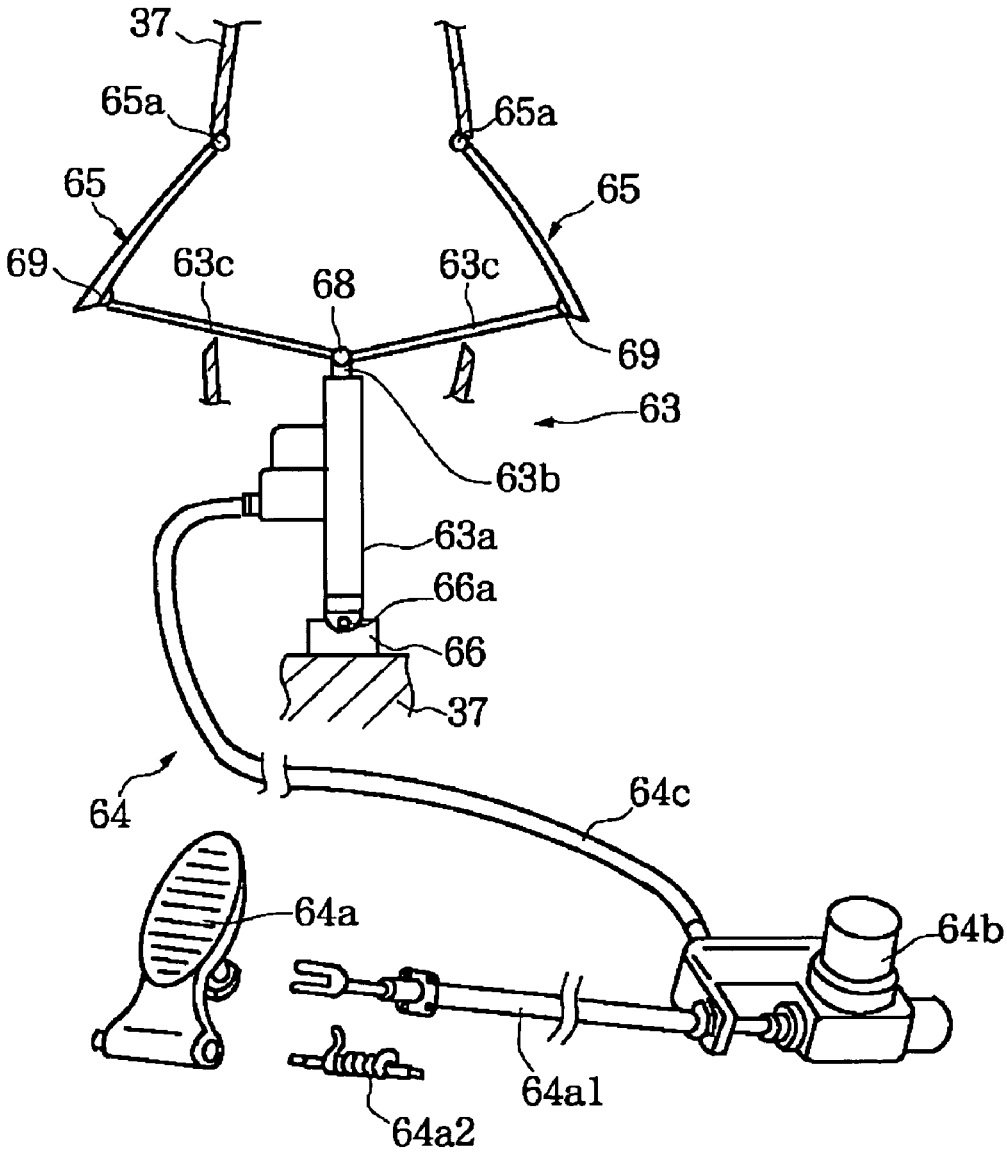
FIG. 13 shows a condition under which the braking operation is performed.

Another modification of the braking device 50 is described with reference to FIGS. 11 through 13 and is identified generally by the reference numeral 50". FIGS. 11(*a*) and 11(*b*) are perspective views showing an embodiment in which the resistance member is part of the lower casing. FIG. 12 shows a normal cruising condition and FIG. 13 shows a condition under which the brake operation is performed during cruising.

The braking device 50" can include a resistance member 65, a resistance member opening/closing mechanism 63 and a brake operation means 64. In some embodiments, the resistance member 65 can be part 37*a* of the lower casing 37.

The part 37*a* of the lower casing 37 can be formed on the left and right sides of the lower casing 37 in the cruising direction, with each designed to pivot about a rotational shaft 65*a* to open a resistance surface 37*a*1 or the forward part in the cruising direction such that the water flows downward. The part 37*a* of the lower casing 37 can have an inclined surface 37*a*2 on its rear side in the cruising direction. Such an inclined surface 37*a*2 can be engaged with an inclined surface 37*c* of the lower casing 37, so that the part 37*a* of lower casing 37 can be prevented from rotating inward of the lower casing 37.

The resistance member opening/closing mechanism 63 can have a cylinder 63*a*, a rod 63*b* and links 63*c*, although other configurations can also be used. The mechanism 63 can be configured to open/close the part 37*a* of the lower casing 37 provided on the main propulsion unit 34, such that the water can flow downwardly, or in the direction approximately perpendicular to the water flow. The cylinder 63*a* and the rod 63*b* can be assembled in a sliding manner. One end of the cylinder 63*a* can be connected to a mounting portion 66 formed on the lower casing 37 for rotation about a support pin 66*a* as a pivot. One end of the rod 63*b* can be connected to each end of the links 63*c* via a connecting pin 68. Each other end of the links 63*c* can be connected pivotably about a corresponding connecting pin 69 provided on the part 37*a* of the lower casing 37.

The brake operation device 64 can have a brake pedal 64*a*, a hydraulic pressure feeder 64*b* and a brake hose 64*c*, although other configurations can also be used. Operating the brake pedal 64*a* activates the hydraulic pressure feeder 64*b* via a cable 64*a*1. This allows hydraulic fluid to be fed to the cylinder 63*a* through the bake hose 64*c* to push the rod 63*b*. Thus, the rod 63*b* causes the part 37*a* of the lower casing 37 to pivot about the rotational shaft 65*a* via each link 63*c* to open the resistance surface 37*a*1, such that the water flows downwardly or in the direction approximately perpendicular to the water flow.

During cruising, as shown in FIG. 12, the lower casing 37 functions in engagement with the resistance member 65. Operating the brake operation device 64 by depressing the brake pedal 64*a* during the cruising allows the hydraulic pressure feeder 64*b* to activate via the cable 64*a*1 and feed the hydraulic fluid to the cylinder 63*a* through the brake hose 64*c* to push the rod 63*b*. This causes the resistance member 65 to pivot about the rotational shaft 65*a* to open the resistance surface 37*a*1, such that the water flows downwardly or in the direction approximately perpendicular to the water flow. The resistance surface 37*a*1 impacts against the flow of water thereby producing a force to lift the main propulsion unit 3 upwardly. Thus, the stern of the associated boat can be lifted upwardly while the bow can be moved downwardly. As such, the surface area of the bow portion of the hull that contacts the water can increase, thus generating more water resistance and providing a shorter stopping distance.

Releasing the brake pedal 64*a* allows it to return to its initial position by a spring 64*a*2, which causes the hydraulic fluid in the cylinder 63*a* to return to the hydraulic pressure feeder 64*b* through the brake hose 64*c*.

Figure 14:
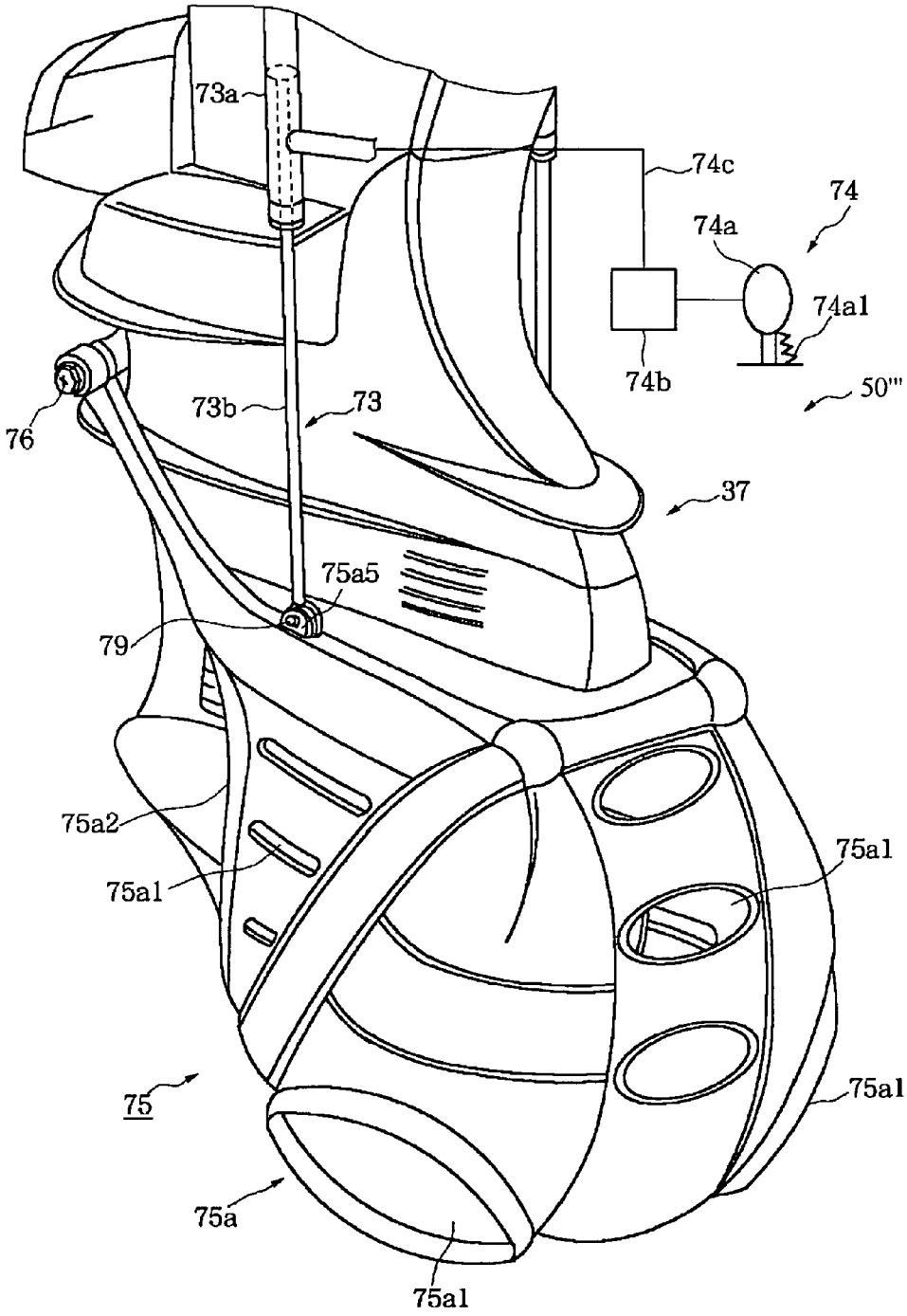
FIG. 14 is a side view, showing an embodiment in which a resistance member is a bucket having a water flow relief opening.
Figure 15:
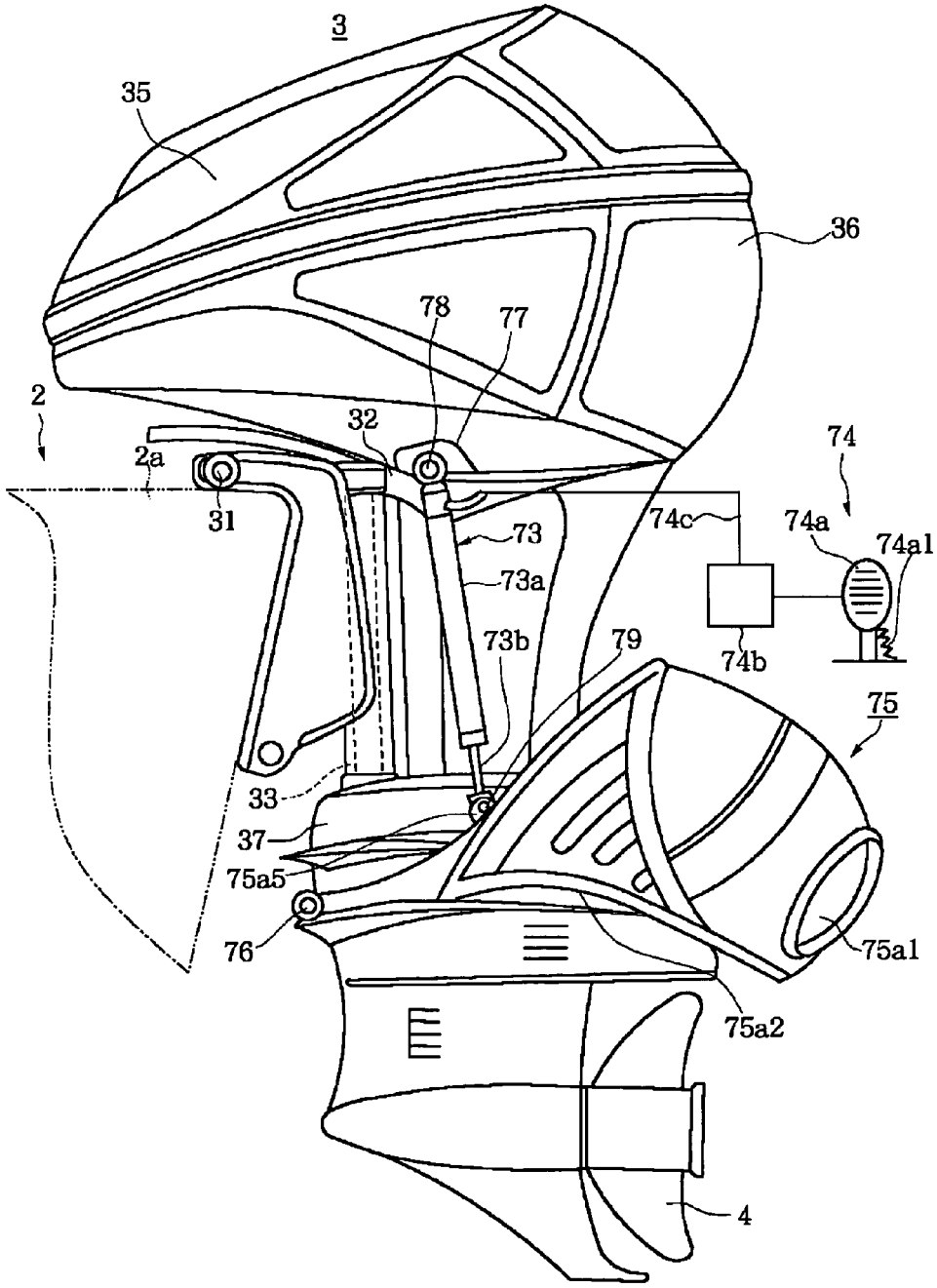
FIG. 15 shows a condition under which no braking operation is performed during cruising.
Figure 16:
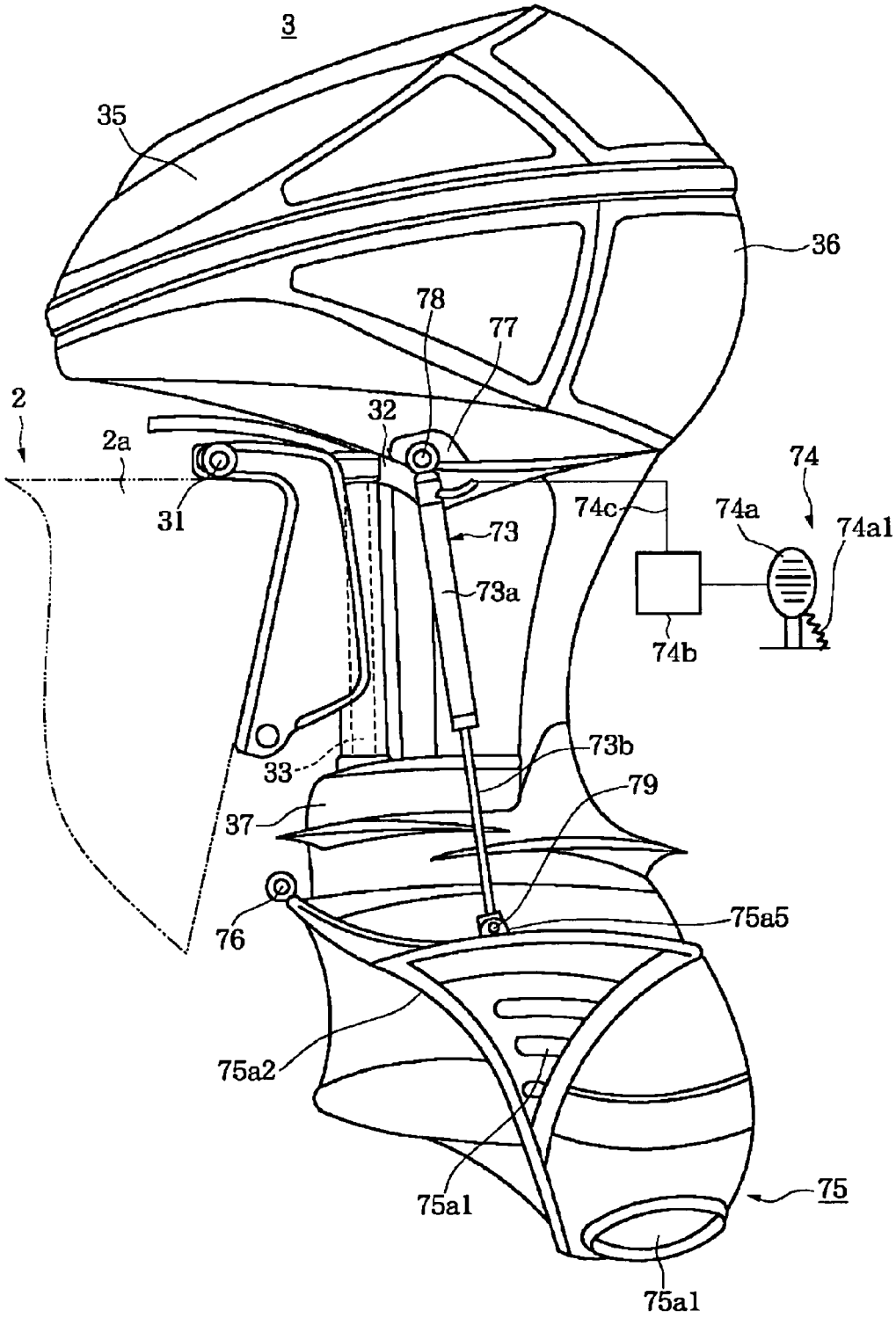
FIG. 16 shows a condition under which the braking operation is performed.

Yet another modification of the braking device 50 is described with reference to FIGS. 14 through 16 and is identified generally by the reference numeral 50'". FIG. 14 is a side view showing an embodiment in which the resistance member is a bucket having water-flow relief openings. FIG. 15 shows a condition under which no brake operation can be performed during cruising. FIG. 16 shows a condition under which the brake operation can be performed.

The braking device 50'" can have a resistance member 75, a resistance member opening/closing mechanism 73 and a brake operation means 74, although other configurations can also be used. The resistance member 75 can include a bucket 75*a* having water-flow relief openings 75*a*1. The bucket 75*a* can be disposed over the left and right sides of the lower casing 37 in the cruising direction for up/down rotation about a support shaft 76 as a pivot. The bucket 75*a* can also cover the propeller 4 and can have an opening on its forward part in the cruising direction. The water-flow relief openings 75*a*1 can be formed on the left and right sides and the rear part, as well as on the left- and right-rear parts.

Water flow can be released from the water-flow relief openings 75*a*1 formed on the left and right sides and the rear part, as well as on the left- and right-rear parts, and from an opening 75*a*2 formed forward in the cruising direction in order that no excessive force acts on the bucket 75*a*. The size, number and location of the water-flow relief openings 75*a*1, formed on the left and right sides and the rear part, as well as on the left- and right-rear parts, and the opening 75*a*2, formed forward in the cruising direction, can be determined to provide the desired performance.

The resistance member opening/closing mechanism 73, which can include a cylinder 73*a* and a rod 73*b*, can be designed to open/close the bucket 75*a* provided on the main propulsion unit 34. The cylinder 73*a* and the rod 73*b* can be assembled in a sliding manner. One end of the cylinder 73*a* can be connected to a mounting portion 77 on the upper casing 36 for rotation about a support pin 78 as a pivot. One end of the rod 73*b* can be supported by a mounting portion 75*a*5 of the bucket 75*a* via a support pin 79.

The brake operation device 74 can include a brake pedal 74*a*, a hydraulic pressure feeder 74*b* and a brake hose 74*c*, although other configurations can also be used. The brake hose 74*c* can communicate with the cylinder 73*a*. During cruising, as shown in FIG. 15, the bucket 75*a* is biased so as to stay in the upper position and rearward of the main propulsion unit 34 to prevent it from creating any substantial the water resistance.

Operating the brake pedal 74*a* can activate the hydraulic pressure feeder 74*b* to feed hydraulic fluid to the cylinder 73*a* through the brake hose 74*c*, as shown in FIG. 16, thereby pushing the rod 73*b*. This allows the bucket 75*a* to rotate downwardly about the support shaft 76 so that the bucket 75*a* covers the propeller 4.

Thus, the water pressure due to water flow created by the propeller 4 covered with the bucket 75*a*, acts on the bucket 75*a*. Such a simple structure as using the bucket 75*a* creates a force to lift the main propulsion unit 34 upwardly. Thus, the stern can be lifted upwardly while the bow can be moved downwardly. As such, the surface area of the bow portion of the hull that contacts the water can increase. This increases the water resistance against the bow and therefore produces a greater braking force. More water resistance against the bow provides a shorter stopping distance for the associated boat.

Releasing the brake pedal 74*a* allows itself to return to its initial position by a spring 74*a*1, which causes the hydraulic fluid in the hydraulic pressure feeder 74*b* to return to the cylinder 73*a* through the brake hose 74*c*. Therefore, the rod 73*b* of the cylinder 73*a* retracts, thereby returning the bucket 75*a* to the position shown in FIG. 15.

In some embodiments, the resistance member 75 can be supported by the lower casing 37, and can include the bucket 75*a* with the water-flow relief openings 75*a*1. Such a simple structure as using the bucket 75*a* can create a force to lift the main propulsion unit 34 upwardly.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A propulsion unit configured to be connected to a transom plate of a hull, the propulsion unit comprising a stern drive or an outboard motor configured to be supported by a transom plate of a boat, the propulsion unit also including a propeller configured to produce thrust, a power device configured to drive the propeller, a power transmission mechanism configured to transmit power from the power device to the propeller, a cavitation plate disposed above the propeller and comprising at least a rearward part, and a braking device configured to exert a generally upward force on the propulsion unit, wherein the braking device comprises a resistance member forming part of the cavitation plate provided on the propulsion unit forward of the rearward part and extending along left and right sides of the propulsion unit, a resistance member opening/closing mechanism configured to open and close the resistance member such that, in the open position, the resistance member acts directly on the water to guide the water to flow downwardly relative to a flow of water past the propulsion unit during forward movement through water, and a brake operation device configured to operate the resistance member opening/closing mechanism to open the resistance member during cruising, wherein the rearward part of the cavitation plate comprises a forward edge, the resistance member comprising a rearward edge, the rearward part and the resistance member being arranged such that the rearward and forward edges are aligned when the resistance member is in the closed position.

2. The propulsion unit according to claim 1, wherein the resistance member, which forms a part of the cavitation plate, is pivotally connected to a lower case of the propulsion unit, and wherein the opening/closing mechanism comprises a cylinder and rod arrangement configured to move the resistance member between the opened and closed positions.

3. The propulsion unit according to claim 1, wherein the brake operation device comprises a brake pedal hydraulically connected to the opening/closing mechanism.

4. The propulsion unit according to claim 3 additionally comprising a spring configured to return the brake pedal to a resting position, against forces of the hydraulic connection between the brake pedal and the opening/closing mechanism.

5. The propulsion unit according to claim 1, wherein rearward part of the cavitation plate comprises a downwardly inclined edge and the resistance member comprising an upwardly inclined edge configured to engage with the downwardly inclined edge.

6. The propulsion unit according to claim 1, wherein rearward part of the cavitation plate comprises a stop configured to prevent the resistance member comprising from moving past the rearward part.

7. The propulsion unit according to claim 1, wherein rearward part of the cavitation plate comprises a stop configured to prevent the resistance member comprising from rotating upwardly past the rearward part.

8. A propulsion unit configured to be connected to a transom plate of a hull, the propulsion unit comprising a propeller configured to produce thrust, a power device configured to drive the propeller, a power transmission mechanism configured to transmit power from the power device to the propeller, and a braking device configured to exert a generally upward force on the propulsion unit, the propulsion unit further comprising a first drive device comprising a tilt drive device and a trim drive device configured to rotate the propulsion unit about a tilt shaft over a tilt range of movement and a trim range of movement, respectively the braking device having a second drive device configured to rotate the propulsion unit about the tilt shaft further toward a rear surface of the transom plate beyond the tilt and trim rangers of movement.

9. The propulsion unit according to claim 8, wherein the braking device further comprises a resistance member provided on the main propulsion unit, a resistance member opening/closing mechanism configured to open and close the resistance member such that, in the open position, water is guided to flow downwardly, in a direction generally perpendicular relative to a flow of water past the propulsion unit during forward movement through water, and a brake operation device configured to operate the resistance member opening/closing mechanism to open the resistance member during cruising.

10. The propulsion unit according to claim 9, wherein the resistance member is disposed below a cavitation plate on the propulsion unit.

11. The propulsion unit according to claim 8 additionally comprising a bucket supported at the lower part of the propulsion unit, the bucket including a water-flow relief opening.

12. The propulsion unit according to claim 8, wherein output from the power device is decreased in association with the brake operation.

13. The propulsion unit according to claim 12, in combination with a boat having the hull and the transom plate disposed at a rear end of the hull, the propulsion unit being supported by the transom plate.

14. The propulsion unit according to claim 12, wherein the power device is an engine.

15. The propulsion unit according to claim 12, wherein the braking device is configured to cause the generally upward force to be sufficiently large to cause the bow of the hull to fall and to thereby make more contact with a body of water in which the hull is operating to thereby enhance a braking operation, when the braking device is activated.

16. The propulsion unit according to claim 8 additionally comprising a controller configured to control a power output of the power device, the controller configured to decrease a power output of the power device when the braking device is activated.

17. The propulsion unit according to claim 9, wherein the resistance member is spaced from the propeller such that the resistance member is not impacted by water discharged by the propeller.

18. The propulsion unit according to claim 8, wherein the braking device comprises a brake operation device configured to allow an operator to activate the second drive device.

19. The propulsion unit according to claim 18, wherein the second drive device comprises a cylinder, a piston moveably mounted in the cylinder, and a rod connected to the piston, the piston dividing the cylinder into a first chamber and a second chamber.

20. The propulsion unit according to claim 19, wherein the cylinder is pivotally supported by the propulsion unit with a support shaft.

21. The propulsion unit according to claim 19, wherein the brake operation device comprises a brake pedal, a hydraulic pressure feeder device, and at least a first brake hose connecting the hydraulic feeder device with the second chamber, wherein the hydraulic feeder device is configured to feed hydraulic fluid to the second chamber when the brake pedal is activated.

22. The propulsion unit according to claim 19, wherein the brake operation device comprises a brake pedal, a hydraulic pressure feeder device, and at least a first brake hose connecting the hydraulic feeder device with the second chamber and a second brake hose connecting the hydraulic feeder device with the fist chamber, wherein the hydraulic feeder device is configured to feed hydraulic fluid to the first chamber through the second hose when the brake pedal is released which causes hydraulic fluid to move from the second chamber to the hydraulic feeder device through the first hose.

23. The propulsion unit according to claim 18, wherein the brake operation device operates with hydraulic pressure.

24. The propulsion unit according to claim 18, wherein the brake operation device comprises a brake pedal and a hydraulic pressure feeder device configured to direct hydraulic pressure to the second drive device when the brake pedal is activated.

25. The propulsion unit according to claim 18 additionally comprising a braking display device configured to display a braking condition of the braking device, the braking condition display device including a brake operation sensor, a controller, and a light-emitting display, the brake operation sensor configured to detect operation of the brake operation device and to send a brake operation detection signal to the controller, the controller being configured to activate the light-emitting display based on the signal.

26. The propulsion unit according to claim 25, wherein the light-emitting display is disposed on a rear side of the propulsion unit.

27. The propulsion unit according to claim 25, wherein the light-emitting display is disposed on a rear side of the hull.

28. The propulsion unit according to claim 8 additionally comprising a braking display device configured to display a braking condition of the braking device.

29. A propulsion unit configured to be connected to a transom plate of a hull, the propulsion unit comprising a stem drive or an outboard motor comprising a housing configured to be supported by a transom plate of a boat, the propulsion unit also including a propeller configured to produce thrust, a power device configured to drive the propeller, a power transmission mechanism configured to transmit power from the power device to the propeller, a cavitation plate assembly disposed above the propeller and extending along left and right sides of the propulsion unit, the cavitation plate assembly comprising a first portion fixed relative to the housing and a second deployable portion disposed forward from the first portion, and an actuator configured to move the second deployable portion between a retracted position and a deployed position, wherein the second deployable portion is aligned with the first portion when in the retracted position and is spaced downwardly away from the first portion when in the deployed position.

30. The propulsion unit according to claim 29, wherein the second deployable position is pivotally connected to the housing, such that a rear edge of the second deployable portion moves downwardly away from a forward edge of the first portion when the second deployable portion moves from the retracted position to the deployed position.

31. The propulsion unit according to claim 30, wherein the rear edge of the second deployable position is pivotally connected to the housing, such that a rear edge of the second deployable portion moves downwardly away from a forward edge of the first portion when the second deployable portion moves from the retracted position to the deployed position.

* * * * *

UNITED STATES PATENT AND TRADEMARK OFFICE

CERTIFICATE OF CORRECTION

PATENT NO. : 7,481,688 B2
APPLICATION NO. : 11/222017
DATED : January 27, 2009
INVENTOR(S) : Noboru Kobayashi It is certified that error appears in the above-identified patent and that said Letters Patent is hereby corrected as shown below:

In column 10, line 62, in Claim 8, change "respectively" to --respectively,--.

In column 10, line 65, in Claim 8, change "rangers" to --ranges--.

In column 12, line 2, in Claim 22, change "fist" to --first--.

In column 12, line 32, in Claim 29, change "stem" to --stern--.

Signed and Sealed this

Thirtieth Day of March, 2010

David J. Kappos

David J. Kappos
*Director of the United States Patent and Trademark Office*